US009776414B1

(12) United States Patent
Ulacia Portoles et al.

(10) Patent No.: US 9,776,414 B1
(45) Date of Patent: Oct. 3, 2017

(54) PRINT PEN CAPPING APPARATUS

(71) Applicants: Rafael Ulacia Portoles, Sant Cugat del Valles (ES); David Soriano Fosas, Vancouver, WA (US); Luis Garcia Garcia, Sant Cugat del Valles (ES)

(72) Inventors: Rafael Ulacia Portoles, Sant Cugat del Valles (ES); David Soriano Fosas, Vancouver, WA (US); Luis Garcia Garcia, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/089,199

(22) Filed: Apr. 1, 2016

Related U.S. Application Data

(63) Continuation of application No. 14/351,999, filed as application No. PCT/EP2011/069149 on Oct. 31, 2011, now abandoned.

(51) Int. Cl.
*B41J 2/165* (2006.01)

(52) U.S. Cl.
CPC ..... *B41J 2/16505* (2013.01); *B41J 2/16508* (2013.01); *B41J 2/16511* (2013.01); *B41J 2/16547* (2013.01)

(58) Field of Classification Search
CPC ..... B41J 2/16505; B41J 2/16508; B41J 2/16511; B41J 2/16547
See application file for complete search history.

(56) References Cited

U.S. PATENT DOCUMENTS

2008/0231655 A1* 9/2008 Yamada ..... B41J 2/16585 347/30
2008/0238959 A1* 10/2008 Kato ..... B41J 11/007 347/8
2008/0278537 A1* 11/2008 Watanabe ..... B41J 2/16538 347/32

FOREIGN PATENT DOCUMENTS

ES WO 2013064168 A1 * 5/2013 ..... B41J 2/16511

* cited by examiner

*Primary Examiner* — Henok Legesse
(74) *Attorney, Agent, or Firm* — HP Inc.—Patent Department

(57) ABSTRACT

A print pen capping apparatus for a printer comprises a cap station carrying one or more caps, wherein the cap station is moveable between a retracted position in which the cap station is arranged at a side of a print media path and a capping position adjacent the media path for capping the print pen.

20 Claims, 3 Drawing Sheets

PRINT PEN CAPPING APPARATUS

BACKGROUND

Printers sometimes have one or more pens, which may be capped when not in use in order to improve longevity and reliability of the pen, and/or to prevent a loss of print quality.

In some environments, the footprint (e.g. floor space) of the printer may be an important factor. Also, providing less complex components may lead to improvements in reliability and/or reductions in cost.

It is an object of examples of the invention to at least mitigate one or more problems associated with the prior art.

BRIEF DESCRIPTION OF THE DRAWINGS

Examples of the invention will now be described by way of example only, with reference to the accompanying figures, in which.

DETAILED DESCRIPTION

Some types of printer employ a print head that moves backwards and forwards across a print media in a direction transverse to a direction in which the print media is advanced. However, because the print head may spend a significant period of time moving across the print media, printers have been developed which include a print head which spans the print media and is stationary i.e. does not move across the print media, or which spans the whole media and may only move a small amount. This technology is often referred to as page wide array (PWA). In PWA printer, the print head is capable of simultaneous printing across the entire width of the print media. The print media is advanced after printing across the entire width of the media one swath at a time, thus improving a speed of printing since the print head is not required to be moved transverse to the print media. Examples of the present invention will be described with reference to a PWA printer, although it will be realised that examples of the invention may be envisaged which include a moveable print head which moves transversely across the print media.

Print head capping is used to seal print pens of the print head to improve a reliability of the print pens. In examples of the present invention, a print cap station is provided which includes a plurality of print caps for capping print pens. The cap station is moveable between a retracted position and a capping position. In the retracted position the cap station is stored at a side of a print media path. In some examples of the invention, the cap station is formed from a plurality of substantially rigid cap modules which are each connected together by hinges. In the retracted position, the cap station is folded at the side of the print media path. The cap station is moved to the capping position by extending the cap station transversely across the print media. In the capping position, the print head is capable of engaging with the cap station, such that caps provided on the cap station seal print pens of the print head.

An example of the invention will now be described with reference to FIG. 1. Examples of the present invention will be described with reference to inkjet printers in which each print pen includes one or more nozzles for ejecting droplets of ink such as by thermal or piezoelectric stimulation. However it will be realised that examples of the invention may also be envisaged in which the print pens are based on other technologies such as toner-based printers including laser or LEDS printers.

Figure 1:
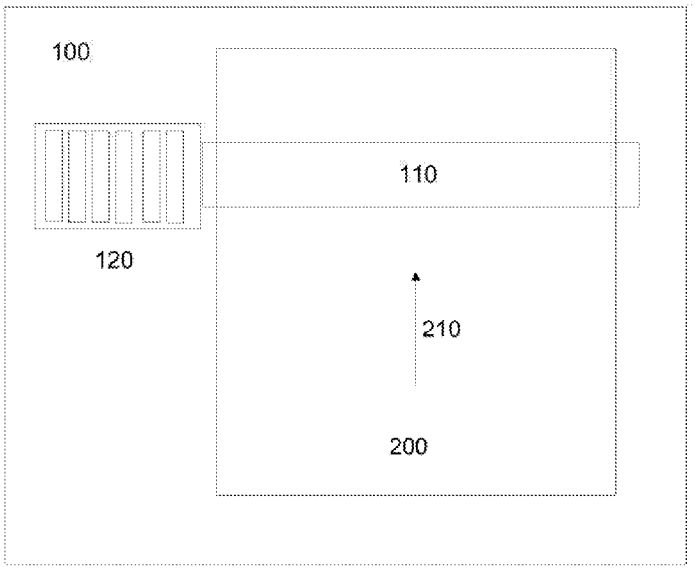
FIG. 1 is a schematic illustration of a printer according to an example of the invention having a cap station in a retracted position.

FIG. 1 is an overhead schematic illustration of a printer 100. The printer 100 is arranged to print on a print media 200 which is advanced in an advance direction 210 underneath a print head 110. In FIG. 1 the print media is shown as a discrete piece i.e. a piece of paper. Examples of the invention may also be used with continuous print media, such as that provided from a roll. In the example of FIG. 1 the print head is a page-wide-array (PWA) print head 120 which spans an entire width of the print media 200 and thus is not required to move transversely across the print media, although embodiments of the invention may be envisaged which are capable of transverse movement. The print head thus comprises a plurality of print pens in a side-by-side arrangement spanning the print media 200.

At a side of the print media 200 adjacent the print head 110 a cap station 120 is arranged, as shown in FIG. 1, in a retracted position. In the retracted position the cap station is clear of the print head such that the print head 110 may print on the print media i.e. print pens of the print head 110 are not capped. The cap station 120 is stored, when not in use, in the retracted position. The cap station 120 shown in FIG. 1 is formed from a plurality of generally rigid portions which are connected via hinges to adjacent portions. The hinges are arranged at opposed ends of the cap station portions to allow the cap station portions to independently articulate and allow the cap station 120 to fold in the retracted position. The cap station folds in a concertina or accordion-like manner about the hinges, thus reducing a storage space requirement of the cap station 120. That is, when folded, a hinge connecting first and second portions is arranged at a lower end, whilst a hinge connecting the second and a third portion is arranged at an upper end, and so on. A surface of each cap station portion is arranged to carry one or more caps for sealing one or more print pens of the print head 110. The caps may be formed as, for example, rubber caps having a protruding rim for sealing around the respective print pen, although embodiments of the invention are not limited in this respect.

Figure 2:
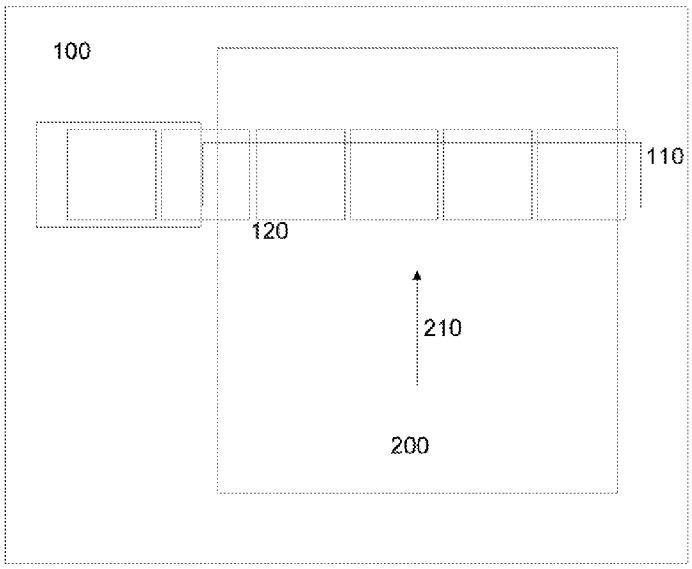
FIG. 2 is a schematic illustration of a printer shown in FIG. 1 with the cap station in a capping position.

The cap station is moveably arranged such that it may be actuated between the retracted position shown in FIG. 1 and a capping position as shown in FIG. 2. Although FIG. 2 shows the print media 200 remaining under the print head it will be understood that generally the cap station will be moved to the capping position when no print media is present.

In the capping position the cap station extends across the print media path in a transverse direction underneath the print head. In the capping position at least a majority of the portions of the cap station 120 are arranged generally horizontally such that the print pens on an underside of the print head 110 may be brought into contact with the caps located on an upper (when in the capping position) surface of the cap station 120. In some examples, the cap station 120 or the caps mounted thereon may be vertically moveable to engage the print pens. However in other examples of the invention the cap station 120 is arranged to move between the retracted position and the capping position when the print head 110 is withdrawn from a printing position proximal to the surface of the print media 200 by being moved vertically upward away from the print media 200. When the cap station 120 is arranged in the capping position the print head 110 may be moved toward the cap station 120, such as in a downward direction, with a predetermined force such that the caps on the cap station engage and cap the print pens on the underside of the print head 110. As a result of the downward movement of the print head or pens, or upward movement of the caps on the cap station 120, the caps at least partially cover the print pens to thereby seal against the print pens.

The cap station 120 may be actuated between the retracted position shown in FIG. 1 and the capping position shown in FIG. 2 in a number of ways. In some examples the cap station 120 may be attached to an impelling cable which extends across the print media 200 and is operated on pulleys, as will be explained further with reference to FIGS. 3 and 4, such that the cap station is moved between the retracted and capping positions by movement of the impelling cable upon the pulleys. In order to provide support to the cap station, a cap station rail is provided along which the cap station portions are guided and supported.

Figure 3:
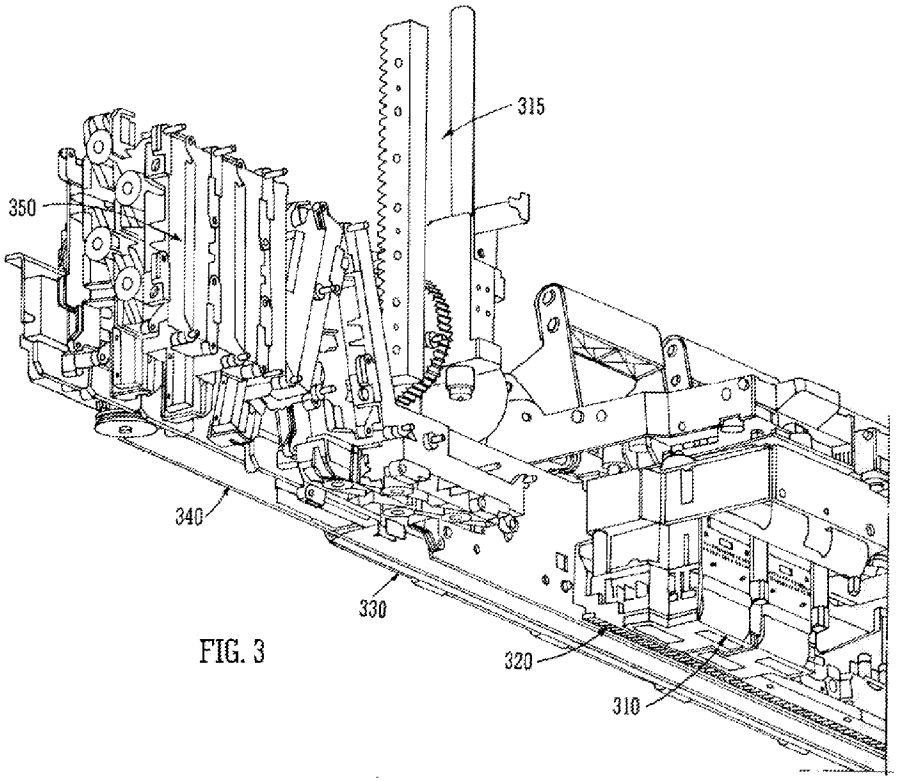
FIG. 3 is a perspective illustration of a printer including a pen capping apparatus according to an example of the invention.
Figure 4:
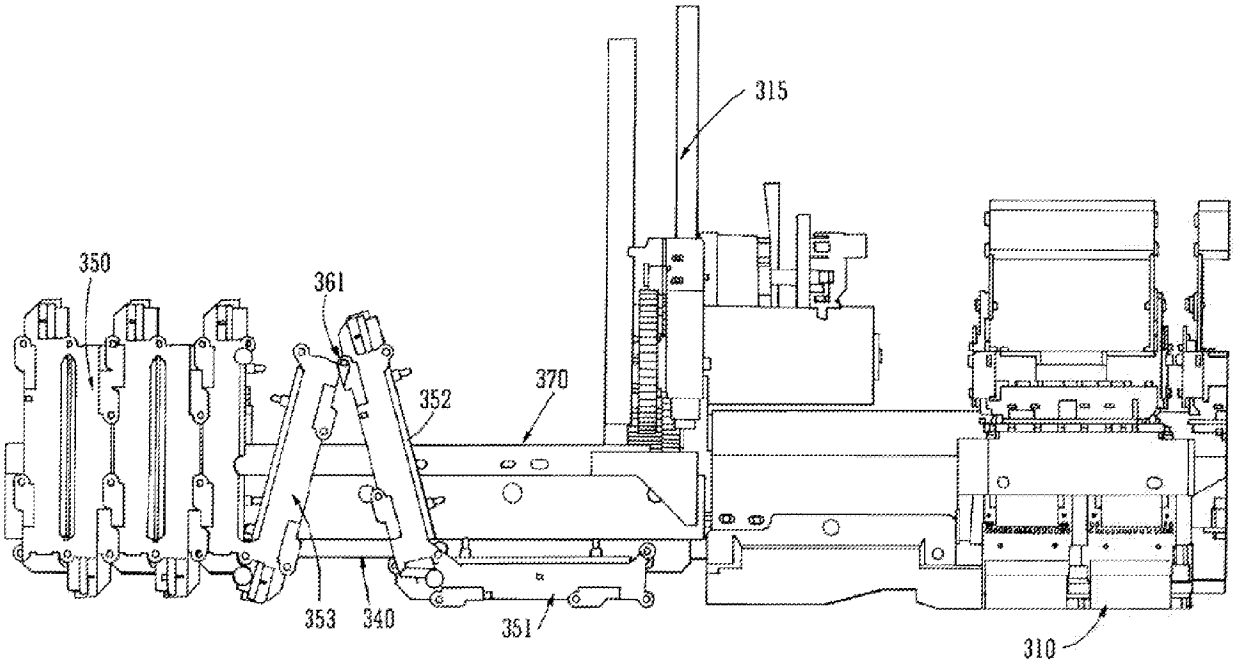
FIG. 4 is a side view of the example printer of FIG. 3.

FIG. 3 illustrates an example of the invention in perspective. The printer 300 shown in FIGS. 3 and 4 comprises a cap station 350 arranged in a retracted position.

The printer 300 comprises a print head 310, only an end of which closest to a cap station 350 in the retracted position is shown. As previously described with reference to FIGS. 1 and 2 the print head is a PWA print head which extends across a print media. The print head 310 is supported upon a print bar 330. The print bar 330 is vertically moveable by a print bar elevator mechanism 315 which may comprise a stepper motor arranged to operate a rack and pinion mechanism, although other arrangements for moving the print bar may be envisaged. As a consequence of the vertical movement of the print bar 330 the print head 310 supported thereon also moves vertically. In a lowered position the print head 310 is located proximal to a print media to print thereon.

The cap station is formed by a plurality of portions 351, 352, 353 not all of which are numbered for clarity. The cap station portions 351, 352, 353 are each substantially rigid and generally elongate. A first cap station portion is suspended in the retracted position generally horizontally and supported upon a cap station guide 370. The first cap station portion is affixed to an impeller cable 340 which runs upon first and second pulleys arranged at either side of the printer. The first cap station portion 351 is moveable by the impeller cable 340 from a first side of the printer 300 in the retracted position to a second side of the printer 300 in the capping position. In the retracted position, the first cap station portion 351 is suspended upon the cap station guide 370. As the first cap station portion 351 advances to the second opposing side of the printer it moves from being supported by the cap station guide to being supported upon the print bar 330. As the first cap station portion 351 is moved by the impeller cable 340 it leaves an open end of rails formed in the cap station guide 370 proximal to the print head 310. The first cap portion 351 enters an open end of a print bar cap guide 320 to be supported upon the print bar underneath the print head 310. The first cap portion continues to be moved toward the second side of the printer 300 along the print bar cap guide 320 by the impeller cable 340.

Second 352, third 353 and further cap station portions are moved from the retracted position in which they are arranged generally vertically in a horizontally-stacked formation to the capping position in which they are supported by the print bar cap guide and, in the case of the end-most cap station portion(s) upon the cap station guide 370. As the first cap station portion 351 moves away from the retracted position the second cap station portion 352 is pulled by means of a first hinge 361 located between the cap station portions 351, 352. In the manner of an extending concertina, the second cap station portion gradually moves from the vertical arrangement to the horizontal arrangement by means of a pulling force exerted from the first cap station portion 351. Similarly the third 353 and further cap station portions gradually move to the horizontal position and travel along the print bar cap guide 320 to extend underneath the print head 310.

As mentioned previously, the cap station portions 351, 352, 353 carry caps on a first side which is an upper side when in the capping position. In order to allow the cap station to extend across the printer 300, the print head 310 is moved by the print bar elevator mechanism 315 in an upward direction. The cap station 350 is then moved from the retracted position to the capping position by the impeller cable 340. Once in the capping position the cap station 350 extends underneath the print head 310. The caps carried upon the cap station 350 are generally vertically aligned with print pens of the print head 310 such that as the print head 310 is caused to move downward with by the print bar elevator mechanism 315 the print pens engage corresponding caps on the cap station 350 to thereby cap the print pens. To uncap the print pens, the print bar is caused to move upward to thereby separate the caps and the print pens before the cap station is moved to the retracted position by opposing movement of the impeller cable 340. As the cap station 350 moves from the capping position to the retracted position the cap station portions 351, 352, 353 generally concertina by moving from the horizontal arrangement in the capping position to the vertical arrangement in the retracted position by rotating about the hinges 361. It will be appreciated that some of the cap station portions, such as the first cap station portion 351, may still remain in the horizontal arrangement in the retracted position, or in an arrangement between horizontal and vertical. However in some examples, a majority of the cap station portions 352, 353 are arranged in a horizontally stacked formation in the retracted position.

It will be realised that other arrangements of cap station may be envisaged. In one example, in the retracted position the cap station may be arranged in a vertical orientation either upward or downward of the horizontal plane in which the cap station is arranged when in the capping position. For example, the cap station may move by means of an impeller cable toward the first side of the printer wherein the cap station portions travel through an arc vertically downward at the side of the printer. In one example, the cap station may be arranged in the retracted position in a leg of a printer. The cap station portions may also be caused to concertina into a vertically stacked arrangement at the first side of the printer. In another example, the cap station portions may be arranged to wrap around a drum located at the first side of the printer. In some examples, the cap station may be a flexible substrate carrying print pens caps thereon.

In the example of FIG. 3 the cap station is supported upon the print bar 330 in the capping position, but other arrangements are possible. For example, a cap station beam could be provided to suspend and/or guide the cap station in/into the capping position.

Advantageously, embodiments of the invention may reduce a footprint of the print bar. As the cap station is supported in the capping position upon the print bar, a further support bar may not be required in some embodiments. This may be particularly useful in large-scale printers as print bars extending over a large print media may be difficult to design to meet maximum bow specifications.

It will be appreciated that embodiments of the present invention can be realised in the form of hardware, software or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are embodiments of machine-readable storage that are suitable for storing a program or programs that, when executed, implement embodiments of the present invention. Accordingly, embodiments provide a program comprising code for implementing a system or method as claimed in any preceding claim and a machine readable storage storing such a program. Still further, embodiments of the present invention may be conveyed electronically via any medium such as a communication signal carried over a wired or wireless connection and embodiments suitably encompass the same.

Any form of print pen may be used in conjunction with embodiments of present invention. The term pen, as used herein, includes any form of print nozzle, drop generator, image generator or applicator of a printer to which a cap or lid may be applied when not in use.

References to orientations, such as above, below and horizontal are for convenience of description, and other orientations may also be used.

All of the features disclosed in this specification (including any accompanying claims, abstract and drawings), and/or all of the steps of any method or process so disclosed, may be combined in any combination, except combinations where at least some of such features and/or steps are mutually exclusive.

The claims should not be construed to cover merely the foregoing embodiments, but also any embodiments which fall within the scope of the claims.

The invention claimed is:

1. A print pen capping apparatus for a printer, comprising:

a cap station carrying one or more caps, wherein the cap station is moveable between a retracted position in which the cap station is folded at a side of a print media path that is parallel to media movement along the print media path and a capping position in which the cap station is adjacent the media path for capping the print pen and extends across the print media path in a transverse direction to the media movement underneath a print head for capping the print pen on the print head.

2. The capping apparatus of claim 1, wherein the cap station is formed from a plurality of cap station portions connected by interposing hinges.

3. The capping apparatus of claim 2, wherein a first cap station portion of the plurality of cap station portions is suspended generally horizontally when the cap station is in the retracted position.

4. The capping apparatus of claim 1, wherein in the retracted position, the cap station folds into a stack of cap station portions.

5. The capping apparatus of claim 4, wherein a stacking direction of the stack is perpendicular to a plane of the media path.

6. The capping apparatus of claim 4, wherein a stacking direction of the stack is transverse to the media path.

7. The capping apparatus of claim 4, wherein in the retracted position, the cap station portions fold in an accordion-like manner.

8. The capping apparatus of claim 1, wherein in the retracted position, the cap station is wound at the side of the print media path.

9. The capping apparatus of claim 1, wherein in the retracted position, the cap station is stored at the side of the print media path, so as to extend perpendicular to the print media path.

10. The capping apparatus of claim 1, wherein the cap station is formed from a plurality of cap station portions defining a flexible substrate.

11. The capping apparatus of claim 1, wherein the cap station is supported in a guide or on a beam.

12. The capping apparatus of claim 1, wherein in the retracted position, the cap station is stored at the side of the print media path that is laterally disposed to the direction of media travel along the print media path.

13. The capping apparatus of claim 1, wherein the cap station extends from the side of the print media path across the print media path in the transverse direction when disposed in the capping position.

14. The capping apparatus of claim 1, wherein the cap station is not disposed underneath the print media path when in the retracted position.

15. The capping apparatus of claim 1, wherein in the retracted position, the cap station is arranged in a stacked vertical orientation upward from a horizontal plane in which the cap station is arranged when in the capping position.

16. A printing device comprising:

a print pen; and a print pen capping apparatus, the print pen capping apparatus comprising a cap station carrying one or more caps, wherein the cap station is moveable between a retracted position in which the cap station is arranged at a side of a print media path and a capping position adjacent the media path and extending across the print media path in a transverse direction to media movement along the print media path for capping the print pen.

17. The printing device of claim 16, further comprising a print support member arranged to support the print pen, and a cap support member arranged to support the capping apparatus, wherein the print support member is moveable substantially perpendicular to the print media path, and the cap support member is immovable in a perpendicular direction relative to the print media path.

18. A method of capping a printer print pen, the method comprising:

moving a capping apparatus between a first and a second position, wherein:

in the first position the capping apparatus extends a first distance transversely across a print media path to a direction of media movement along the print media path for capping a print pen of the printer; and in the second position the capping apparatus is stored at a side of the print media path and arranged such that an extent of the capping apparatus in a direction transverse to the print media path is less than the first distance.

19. The method of claim 18, wherein:

the side of the printer is parallel to-media movement along the print media path.

20. The method of claim 18, comprising:

passing a print medium along the print media path; and printing on the print medium with the print pen, wherein the moving the capping apparatus is performed at least one of before or after the passing the print medium and the printing on the print medium.

* * * * *